US007637222B1

(12) United States Patent
Keely

(10) Patent No.: US 7,637,222 B1
(45) Date of Patent: Dec. 29, 2009

(54) MOORING DEVICE, AND METHOD FOR HOLDING FAST A WATER CRAFT

(76) Inventor: Robert Sean Keely, 904 Jaywood La., Matthews, NC (US) 28105

( * ) Notice: Subject to any disclaimer, the term of this patent is extended or adjusted under 35 U.S.C. 154(b) by 0 days.

(21) Appl. No.: 11/641,385

(22) Filed: Dec. 18, 2006

(51) Int. Cl.
*E02B 3/24* (2006.01)
*B63B 21/00* (2006.01)

(52) U.S. Cl. ..... 114/230.17; 114/230.1; 114/230.15

(58) Field of Classification Search ..... 114/230.1, 114/230.15, 230.17–230.19
See application file for complete search history.

(56) References Cited

U.S. PATENT DOCUMENTS

| | | | | | |
|---|---|---|---|---|---|
| 2,920,597 | A * | 1/1960 | Dick | 114/230.17 |
| 2,938,492 | A * | 5/1960 | Kulick | 114/230.18 |
| 3,019,759 | A * | 2/1962 | Woods | 114/230.17 |
| 3,074,371 | A * | 1/1963 | Kulick | 114/230.18 |
| 3,177,838 | A * | 4/1965 | Grimes | 114/230.18 |
| 3,993,013 | A * | 11/1976 | Nunziato et al. | 114/221 R |
| 4,144,831 | A * | 3/1979 | Heydolph | 114/230.18 |
| 4,250,827 | A * | 2/1981 | Booker et al. | 114/230.18 |
| 4,482,330 | A * | 11/1984 | Cook | 440/2 |
| 4,686,926 | A * | 8/1987 | Vance | 114/230.18 |
| 4,781,138 | A | 11/1988 | Hay | |
| 4,977,846 | A * | 12/1990 | Landa et al. | 114/230.17 |
| 5,046,442 | A | 9/1991 | Hay | |
| 5,070,805 | A * | 12/1991 | Plante | 114/218 |
| 5,243,926 | A * | 9/1993 | Wright et al. | 114/230.19 |
| 5,408,946 | A * | 4/1995 | Jones et al. | 114/230.1 |
| 5,450,808 | A * | 9/1995 | Beagan | 114/230.18 |
| 5,499,591 | A * | 3/1996 | Chippas | 114/230.15 |
| 5,575,234 | A * | 11/1996 | Dysarz | 114/230.27 |
| 5,676,085 | A * | 10/1997 | Michl, Jr. | 114/230.1 |
| 6,167,828 | B1 * | 1/2001 | Chase | 114/230.15 |
| 6,561,113 | B2 * | 5/2003 | Leise | 114/230.15 |
| 6,672,243 | B2 * | 1/2004 | Seymour et al. | 116/28 R |
| 7,089,877 | B1 * | 8/2006 | Hay | 114/230.17 |

* cited by examiner

*Primary Examiner*—Lars A Olson
*Assistant Examiner*—Daniel V Venne
(74) *Attorney, Agent, or Firm*—Schwartz Law Firm, P.C.

(57) ABSTRACT

A mooring device is adapted for holding fast a water craft on a body of water. The mooring device includes a base designed for engaging the water craft, and an elongated rigid mooring pole. The mooring pole has a proximal end attached to the base, and a free end extending away from the base. The free end of the mooring pole is releasably anchored to an anchoring structure.

14 Claims, 5 Drawing Sheets

MOORING DEVICE, AND METHOD FOR HOLDING FAST A WATER CRAFT

TECHNICAL FIELD AND BACKGROUND

The invention relates generally to a mooring device, and method for holding fast a water craft. The invention is applicable for use on or in connection with water craft of all sizes and designs. In one exemplary implementation, the invention serves to maintain the moored water craft a safe distance from an anchoring structure to prevent damage to the water craft as it shifts and rocks on the water.

SUMMARY OF EXEMPLARY EMBODIMENTS

Therefore, it is an object of the invention to provide a mooring device for water craft of all sizes and designs.

It is another object of the invention to provide a method for safely holding fast a water craft on a body of water.

These and other objects of the present invention are achieved in the exemplary embodiments disclosed below by providing a mooring device adapted for holding fast a water craft on a body of water. The mooring device includes a base designed for engaging the water craft, and an elongated rigid mooring pole. The base may either engage the water craft directly, or may indirectly engage the water craft through intermediate elements. The mooring pole has a proximal end attached to the base, and a free end extending away from the base. The term "proximal end" refers broadly to the end of the mooring pole closest to the water craft, while the term "free end" refers to the end closest the anchoring structure. Either of the proximal and free ends may be permanently attached or unattached to other structure. The base may be either separately integrally formed with the proximal end of the mooring pole. The mooring pole may either attach to the base directly, or may attach to the base indirectly through intermediate elements. Means are provided for releasably securing the free end of the mooring pole to an anchoring structure. The term "anchoring structure" refers broadly to any fixed or floating structure or device located either on or in the water or on shore, and applicable for holding the free end of the mooring pole. In reference to the mooring pole, the term "rigid" means having sufficient stiffness to maintain the water craft a fixedly-spaced or variably-spaced distance from the anchoring structure, such that the water craft does not collide with the anchoring structure when moored.

According to another exemplary embodiment of the invention, the mooring pole incorporates first and second telescoping sections.

According to another exemplary embodiment of the invention, a releasable pin engages the first and second telescoping sections to selectively fix the length of the mooring pole.

According to another exemplary embodiment of the invention, the base includes a base plate having a radiused outside edge.

According to another exemplary embodiment of the invention, the base plate defines a notched inside edge opposite the radiused outside edge.

According to another exemplary embodiment of the invention, an adjustable connector interconnects the base and the proximal end of the mooring pole.

According to another exemplary embodiment of the invention, the connector has at least first and second pivot points for enabling multiple pivoting adjustment of the mooring pole relative to the base.

According to another exemplary embodiment of the invention, means are provided for releasably fixing the first pivot point of the connector. The means may comprise any suitable structure or hardware, such as a locking pin, tie, rivet, fastener, or the like.

According to another exemplary embodiment of the invention, a shock-absorbing spring is located at the proximal end of the mooring pole. The spring may comprise any resilient structure or other biasing means.

According to another exemplary embodiment of the invention, the base has a protective craft-engaging liner.

According to another exemplary embodiment of the invention, the means for releasably securing the mooring pole comprises a flexible tie line. Alternatively, the means may comprise a clamp, claw, hook, anchor, weight, or the like.

According to another exemplary embodiment of the invention, means are provided for releasably securing the base to the water craft.

According to another exemplary embodiment of the invention, the means for releasably securing the base comprises an adjustable ratchet strap. Alternatively, the securing means may comprise a tie line, clamp, claw, hook, anchor, weight, or the like.

According to another exemplary embodiment of the invention, the base incorporates first and second base plates, and means for adjusting and fixing a position of the first plate relative to the second plate. The means may comprise, for example, hardware such as threaded bolts and nuts, rivets, fasteners, or interfering surfaces, frictionally-engaging surfaces, or the like.

In yet another exemplary embodiment, the invention comprises a method for holding a water craft fast on a body of water. The method includes the steps of securing a first end of an elongated rigid mooring pole to the water craft, and securing an opposing second end of the mooring pole to an anchoring structure.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
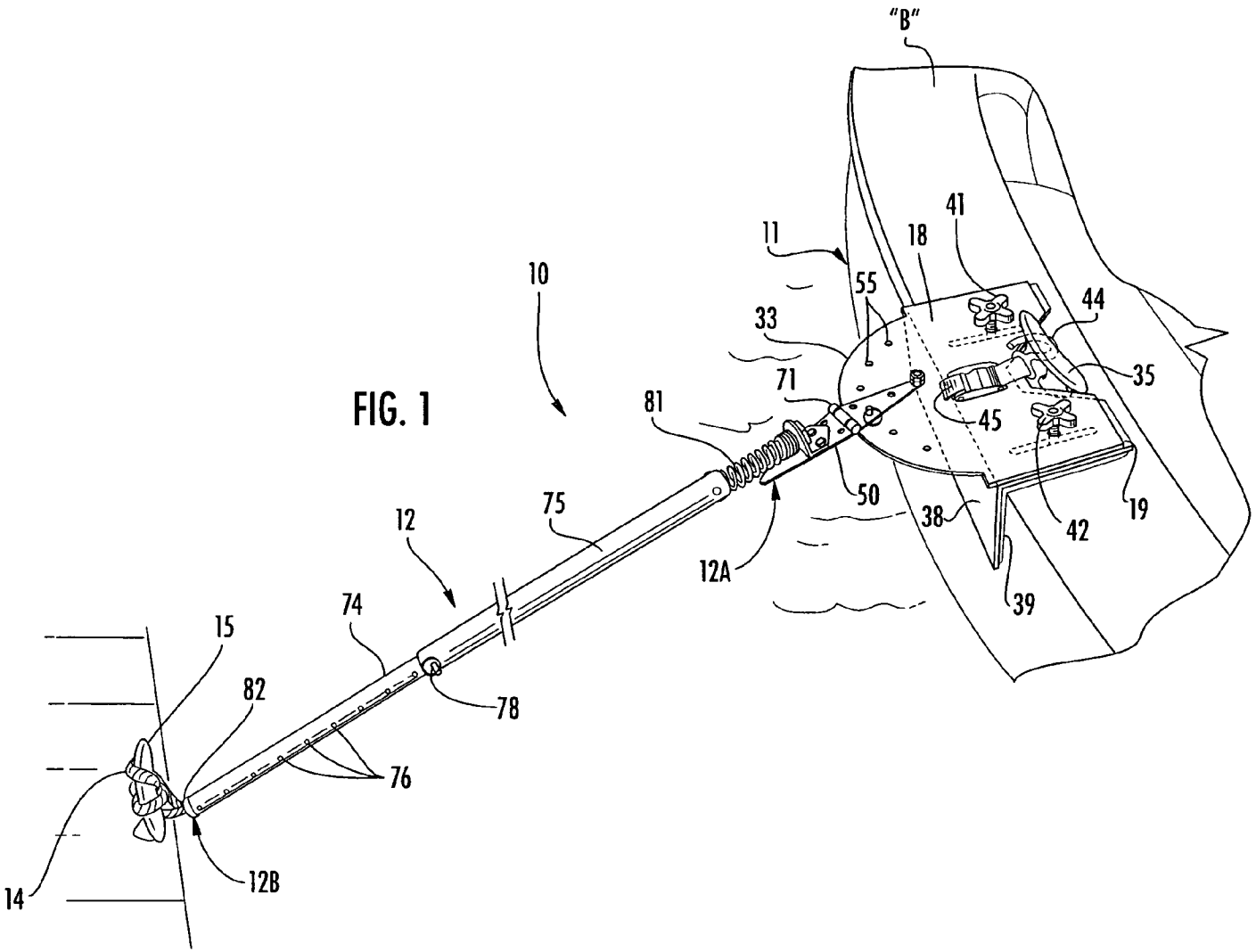
FIG. 1 is an environmental view of a mooring device according to one exemplary embodiment of the present invention.

Referring now specifically to the drawings, a mooring device according to one exemplary embodiment of the present invention is illustrated in FIG. 1 and shown generally at reference numeral 10. The mooring device 10 is especially applicable for holding fast a boat "B" on a body of water. In the embodiment shown, the mooring device 10 includes a base 11 secured to the boat "B", an elongated rigid mooring pole 12 attached at its proximal end 12A to the base 11, and a looped flexible tie line 14 located at a free end 12B of the mooring pole 12. The tie line 14 releasably attaches the mooring pole 12 to an anchoring structure, such as dock cleat 15.

Figure 2:
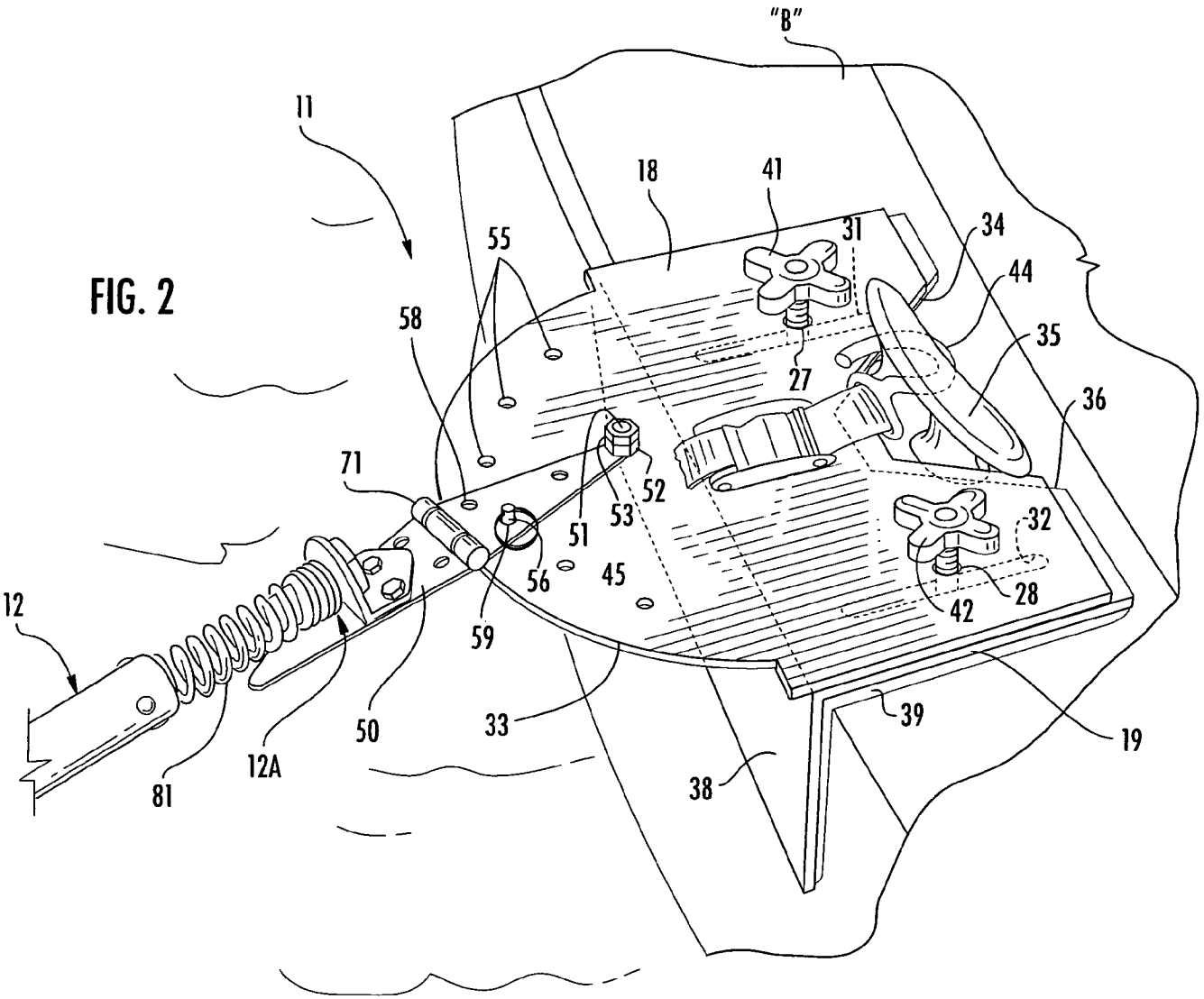
FIG. 2 is an enlarged, fragmentary view illustrating the base of the mooring device.
Figure 3:
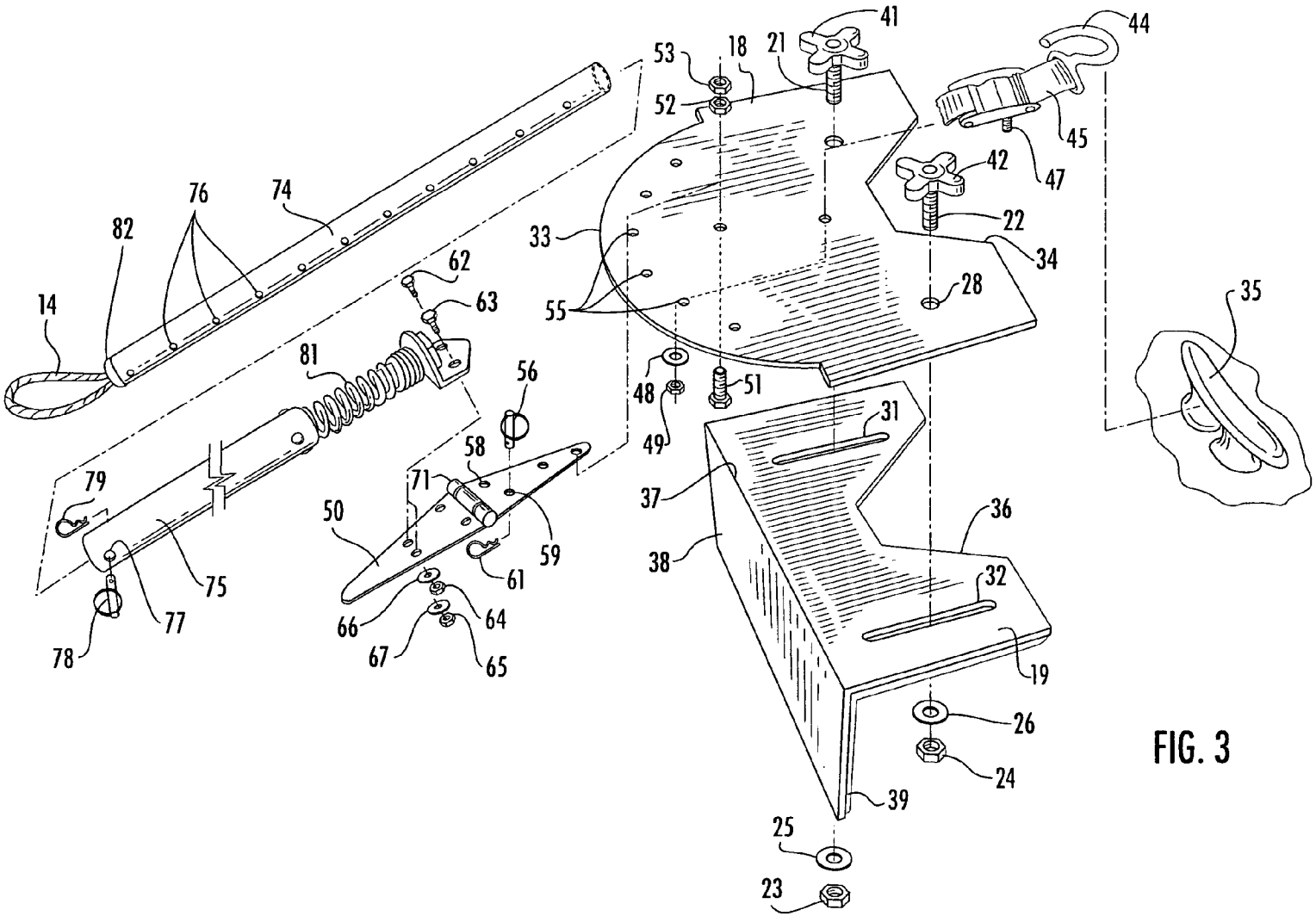
FIG. 3 is a disassembled, exploded view of the mooring device.

As best shown in FIGS. 1, 2, and 3, the base 11 of the mooring device 12 incorporates overlying rigid plates 18, 19 joined together using threaded bolts 21, 22 and complementary self-locking nuts 23, 24 and washers 25, 26. The bolts 21, 22 pass through respective holes 27, 28 formed with the top plate 18, and through respective adjustment slots 31, 32 formed with the bottom plate 19. The slots 31, 32 allow a predetermined range of adjustment of the top plate 18 relative to the bottom plate 19 and boat "B". The top plate 18 may have a radiused outside edge 33 which projects beyond an edge of the boat "B", and a notched inside edge 34 designed to accommodate a boat cleat 35. The inside edge 36 of the bottom plate 19 defines a corresponding cleat notch. The opposite outside edge 37 of the bottom plate 19 extends to the edge of the boat "B", and may be integrally formed with a side plate 38 designed to reside closely adjacent to a side of the boat "B". A rubber liner 39 or other intervening structure may reside adjacent the bottom and side plates 19, 38 to protect the surface of the boat "B". The top plate 18 is fixedly positioned relative to the bottom plate 19 by hand-tightening the bolts 21, 22 using respective knobs 41, 42. The base 11 is then temporarily secured to the boat "B" using a hook 44 and ratchet strap 45. The hook 44 is located at a free end of the ratchet strap 45, and is releasably attached around a neck of the boat cleat 35. The ratchet strap 45 may be mounted to the top plate 18 using suitable hardware 47, 48, and 49, and operates in a conventional manner to force the base 11 tight against the boat "B".

Figure 4:
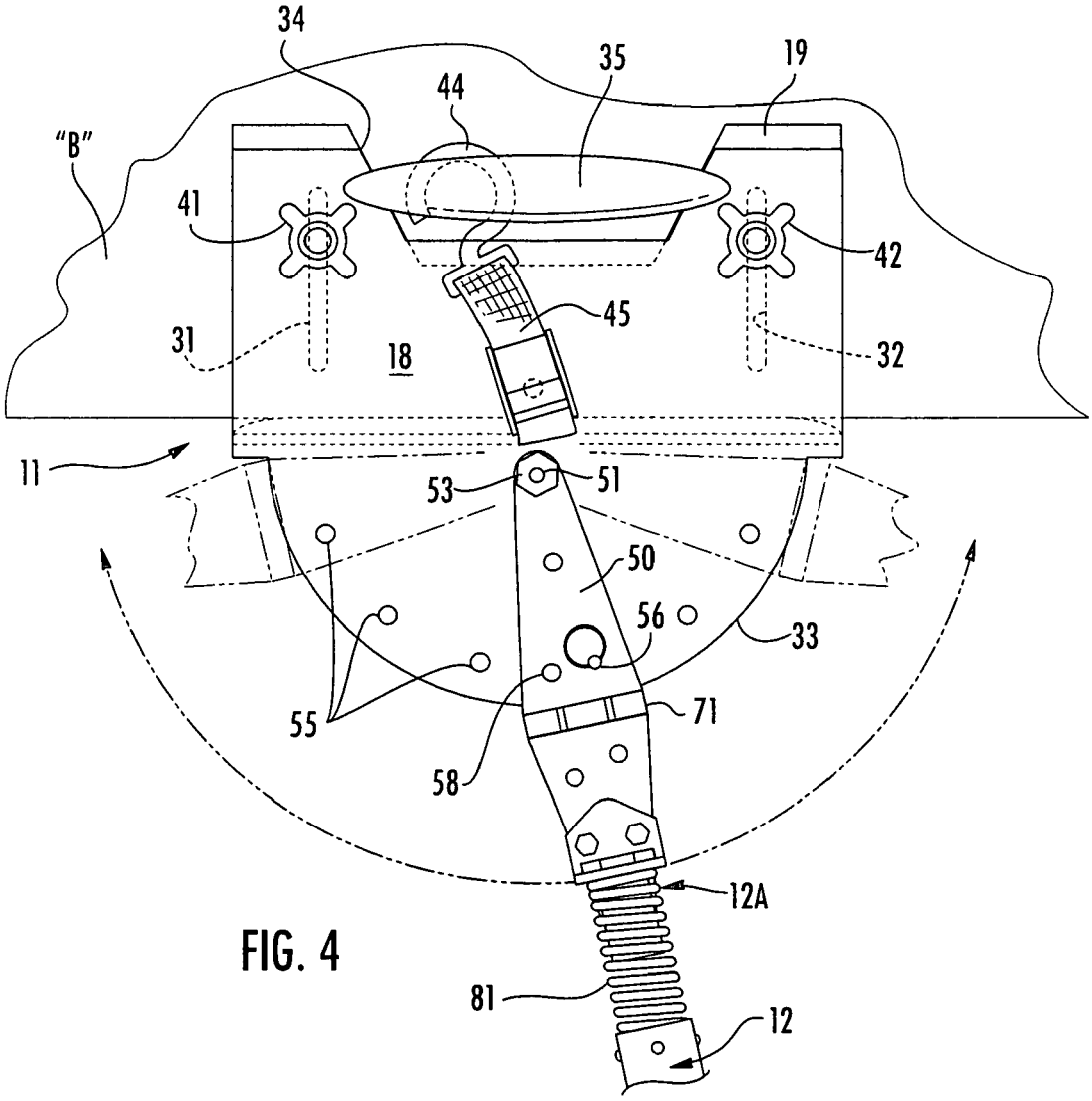
FIG. 4 is a plan view demonstrating pivoting adjustment of the mooring pole about a first pivot point.

In one exemplary embodiment, the mooring pole 12 is secured to the base 11 using a multi-pivoted connector 50. As best shown in FIGS. 2 and 3, the connector 50 is attached to the top plate 18 of the base 11 using a threaded bolt 51 and complementary nuts 52, 53. The bolt 51 defines a first pivot point allowing the mooring pole 12 to extend outwardly from the base 11 at one of several pre-selected angles determined by holes 55 formed near the radiused edge 33. When the desired angle is selected, a locking pin 56 is passed through one of two holes 58, 59 formed with the connector 50, and through an aligned one of the holes 55 formed with the top plate 18. The locking pin 56 sets the angle of the mooring pole 12 relative to the base 11, and may be held secure using cotter pin 61. As demonstrated in FIG. 4, the range of angular adjustment may be 120 degrees or more.

Figure 5:
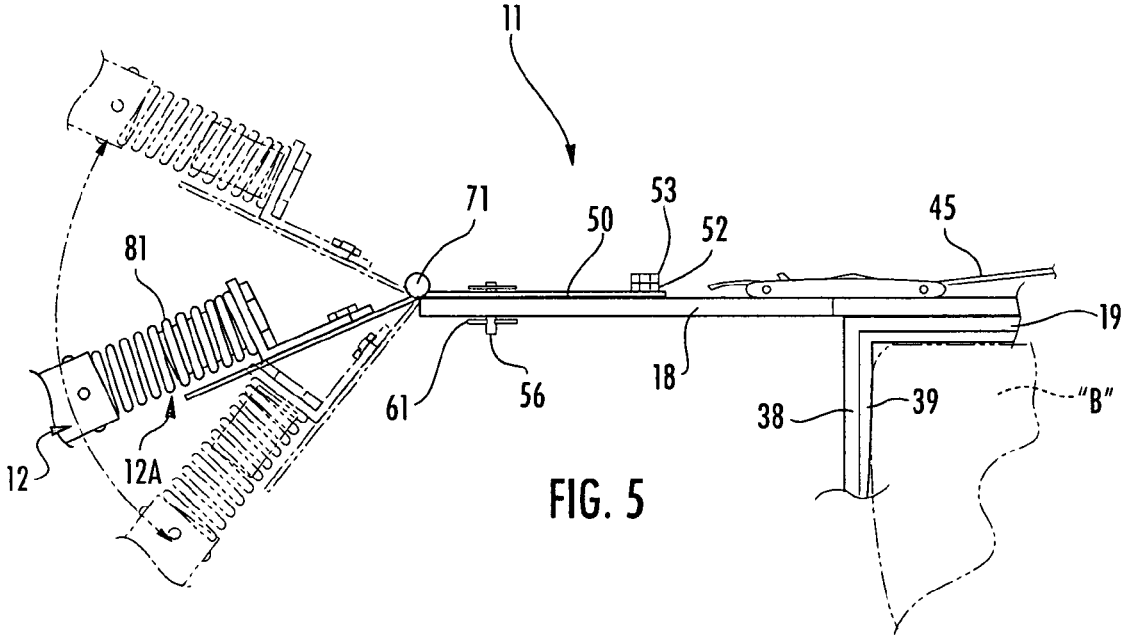
FIG. 5 is a side elevation demonstrating pivoting adjustment of the mooring pole about a second pivot point.

An opposite end of the connector 50 is attached to the proximal end 12A of the mooring pole 12 using hardware, such as threaded bolts 62, 63, nuts 64, 65, and washers 66, 67. An intermediate hinge 71 located between the mooring pole 12 and the radiused outside edge 33 forms a second pivot point of the connector 50. As demonstrated in FIG. 5, the hinge 71 allows free angular movement of the mooring pole 12 in a direction generally perpendicular to the top plate 18. This range of movement may also be 120 degrees or more. The first and second pivot points enable adjustment of the mooring pole 12 along respective perpendicular axises.

The mooring pole 12 may be formed of any rigid material, such as lightweight aluminum or other metal, plastic or fiberglass. For added adjustability, the mooring pole 12 may be formed in multiple telescoping sections 74, 75. The inner section 74 may include several longitudinally-spaced holes 76 designed to selectively align with a single hole 77 formed with the outer section 75. Once the mooring pole 12 is adjusted to a desired length, a locking pin 78 may be inserted through the aligned holes 76, 77 and held secure using cotter pin 79. A high-strength universally flexible coil spring or other resilient structure may be located at one or both of the proximal and free ends of the mooring pole 12 for shock-absorption. In the embodiment shown, spring 81 is located at the proximal end 12A of the mooring pole 12, while a rubber bumper 82 is located at the free end 12B of the mooring pole 12.

After assembly and attachment, as described above, the mooring device 10 operates to maintain a safe distance between the boat "B" and the anchoring structure 15 (e.g., dock) as the boat shifts and rocks on the water. In other embodiments of the invention (not shown), the mooring device may be permanently attached at its base to the water craft and stowed in an appropriate compartment when not in use. For particularly large craft, the telescoping mooring pole may be extended via hydraulics or other such means. The mooring device may also be permanently attached to the anchoring structure, and designed for releasable attachment to the water craft. To prevent inadvertent submersion of the mooring device, one or more floatation devices may be attached on or near the mooring pole, base, or tie line.

Exemplary embodiments of the present invention are described above. No element, act, or instruction used in this description should be construed as critical or essential to the invention unless explicitly described as such. Various details of the invention may be changed without departing from its scope. Furthermore, the foregoing description of the exemplary embodiments of the invention and best mode for practicing the invention are provided for the purpose of illustration only and not for the purpose of limitation—the invention being defined by the claims and their equivalents.

I claim:

1. A mooring device adapted for holding fast a water craft on a body of water, said mooring device comprising:

a base having a radiused outside edge;

an elongated rigid mooring pole having a proximal end extending towards said base, and a free end extending away from said base;

a universally flexible shock-absorbing spring projecting from the proximal end of said rigid mooring pole;

an adjustable connector interconnecting said shock-absorbing spring and said base, said connector comprising a first pivot point located beyond the radiused outside edge of said base, and a second pivot point located within an area of said base, and said first and second pivot points enabling multi-angular adjustment of said mooring pole relative to said base along respective perpendicular axes; and means for releasably securing said rigid mooring pole to an anchoring structure, whereby said mooring device operates to maintain a safe distance between the water craft and the anchoring structure while shock created by rocking and shifting of the water craft on the body of water is absorbed by said flexible shock-absorbing spring projecting from said rigid mooring pole.

2. A mooring device according to claim 1, wherein said mooring pole comprises first and second telescoping sections.

3. A mooring device according to claim 2, and comprising a releasable pin engaging said first and second telescoping sections to selectively fix the length of said mooring pole.

4. A mooring device according to claim 1, wherein said base plate defines a notched inside edge opposite said outside edge.

5. A mooring device according to claim 1, and comprising means for releasably fixing the first pivot point of said connector, said means comprising a releasable locking pin adapted for inserting through aligned holes formed with said connector and said base.

6. A mooring device according to claim 1, wherein said base comprises a protective craft-engaging liner.

7. A mooring device according to claim 1, wherein said means for releasably securing said mooring pole comprises a flexible tie line.

8. A mooring device according to claim 1, and comprising means for releasably securing said base to the water craft.

9. A mooring device according to claim 8, wherein said means for releasably securing said base comprises an adjustable ratchet strap.

10. A mooring device according to claim 1, wherein said base comprises first and second base plates, and means for adjusting a position of said first plate relative to said second plate.

11. A mooring device adapted for holding fast a water craft on a body of water, said mooring device comprising:

a base designed for engaging the water craft, and having a radiused outside edge adapted for extending beyond a side of the water craft;

means for releasably securing said base to the water craft;

an elongated rigid mooring pole having a proximal end extending towards said base, and a free end extending away from said base;

a universally flexible shock-absorbing spring projecting from the proximal end of said rigid mooring pole;

an adjustable connector interconnecting said shock-absorbing spring and said base, said connector comprising a first pivot point located beyond the radiused outside edge of said base, and a second pivot point located within an area of said base, and said first and second pivot points enabling multi-angular adjustment of said mooring pole relative to said base along respective perpendicular axes; and means for releasably securing said rigid mooring pole to an anchoring structure, whereby said mooring device operates to maintain a safe distance between the water craft and the anchoring structure while shock created by rocking and shifting of the water craft on the body of water is absorbed by said flexible shock-absorbing spring projecting from said rigid mooring pole.

12. A mooring device according to claim 11, wherein said mooring pole comprises first and second telescoping sections.

13. A mooring device according to claim 12, and comprising a releasable pin engaging said first and second telescoping sections to selectively fix the length of said mooring pole.

14. A mooring device according to claim 11, wherein said means for releasably securing said mooring pole comprises a flexible tie line.

* * * * *